US008604987B1

(12) United States Patent
Doane

(10) Patent No.: US 8,604,987 B1
(45) Date of Patent: Dec. 10, 2013

(54) STACKABLE ANTENNA CONCEPT FOR MULTIBAND OPERATION

(75) Inventor: Jonathan P. Doane, Cedar Rapids, IA (US)

(73) Assignee: Rockwell Collins, Inc, Cedar Rapids, IA (US)

( * ) Notice: Subject to any disclaimer, the term of this patent is extended or adjusted under 35 U.S.C. 154(b) by 664 days.

(21) Appl. No.: 12/817,746

(22) Filed: Jun. 17, 2010

(51) Int. Cl.
*H01Q 21/28* (2006.01)
*H01Q 21/00* (2006.01)

(52) U.S. Cl.
USPC ..... 343/725; 343/893

(58) Field of Classification Search
USPC ..... 343/725, 774, 799, 893
See application file for complete search history.

(56) References Cited

U.S. PATENT DOCUMENTS 5,767,814 A * 6/1998 Conroy et al. ..... 343/774
8,217,850 B1 * 7/2012 Jennings et al. ..... 343/810
2002/0180644 A1 * 12/2002 Carson et al. ..... 343/700 MS

* cited by examiner

*Primary Examiner* — Robert Karacsony
(74) *Attorney, Agent, or Firm* — Donna P. Suchy; Daniel M. Barbieri

(57) ABSTRACT

The present invention is directed to an antenna assembly. The antenna assembly may include multiple sets of radiators (ex.—antenna elements) with each set of radiators being fed by its own RF feed network. The multiple sets of radiators may be arranged in a stackable configuration for providing a low profile antenna assembly which concurrently supports multiple frequency bands (exs.—L band, C band, $K_u$ band).

14 Claims, 3 Drawing Sheets

STACKABLE ANTENNA CONCEPT FOR MULTIBAND OPERATION

FIELD OF THE INVENTION

The present invention relates to the field of antenna technology and particularly to a stackable antenna concept for multiband operation.

BACKGROUND OF THE INVENTION

A number of currently available Radio Frequency (RF) configurations may implement multiple RF systems (ex.—antennas) on a single platform. These multiple antennas on the single platform add cost, weight, drag and configuration problems for such RF configurations. Further, for many of these currently available systems, providing separate bands has required separate antenna installations and has required separate connections to separate radios. Previously, Ultra-wideband (UWB) antennas have been implemented to obviate some of the above-referenced problems. However, UWB antennas are typically large and often require a diplexor to connect multiple radios.

Thus, it would be desirable to provide an antenna system which obviates the problems associated with currently available RF system implementations.

SUMMARY OF THE INVENTION

Accordingly, an embodiment of the present invention is directed to an antenna assembly, including: a first feed board, the first feed board including a ground plane; a first plurality of radiators, the first plurality of radiators being connected to the first feed board; a first RF feed, the first RF feed being connected to the first feed board and the first plurality of radiators, the first RF feed configured for feeding the first plurality of radiators via the first feed board, wherein the first plurality of radiators, in response to receiving said feeding, is configured for radiating electromagnetic energy in a radiation pattern; a second feed board, the second feed board including a ground plane, the second feed board being connected to and stacked upon the first plurality of radiators; a second plurality of radiators, the second plurality of radiators being connected to the second feed board; a second RF feed, the second RF feed being connected to the second feed board and the second plurality of radiators, the second RF feed configured for feeding the second plurality of radiators via the second feed board, wherein the second plurality of radiators, in response to receiving said feeding from the second RF feed, is configured for radiating electromagnetic energy in a radiation pattern; a third feed board, the third feed board including a ground plane, the third feed board being connected to and stacked upon the second plurality of radiators; an antenna element, the antenna element being connected to the third feed board; and a third RF feed, the third RF feed being connected to the third feed board and the antenna element, the third RF feed being configured for feeding the antenna element via the third feed board, wherein the antenna element, in response to receiving said feeding from the third RF feed, is configured for radiating electromagnetic energy in a radiation pattern, wherein the first plurality of radiators is configured for operating over a first frequency band, the second plurality of radiators is configured for operating over a second frequency band, and the antenna element is configured for operating over a third frequency band.

A further embodiment of the present invention is directed to an antenna device, including: a housing; and an antenna assembly, the antenna assembly being connected to and at least substantially contained within the housing, the antenna assembly including: a first feed board, the first feed board including a ground plane; a first plurality of radiators, the first plurality of radiators being connected to the first feed board; a first RF feed, the first RF feed being connected to the first feed board and the first plurality of radiators, the first RF feed configured for feeding the first plurality of radiators via the first feed board, wherein the first plurality of radiators, in response to receiving said feeding, is configured for radiating electromagnetic energy in a radiation pattern; a second feed board, the second feed board including a ground plane, the second feed board being connected to and stacked upon the first plurality of radiators, a second plurality of radiators, the second plurality of radiators being connected to the second feed board and a second RF feed, the second RF feed being connected to the second feed board and the second plurality of radiators, the second RF feed configured for feeding the second plurality of radiators via the second feed board, wherein the second plurality of radiators, in response to receiving said feeding from the second RF feed, is configured for radiating electromagnetic energy in a radiation pattern; a third feed board, the third feed board including a ground plane, the third feed board being connected to and stacked upon the second plurality of radiators; an antenna element, the antenna element being connected to the third feed board; and a third RF feed, the third RF feed being connected to the third feed board and the antenna element, the third RF feed being configured for feeding the antenna element via the third feed board, wherein the antenna element, in response to receiving said feeding from the third RF feed, is configured for radiating electromagnetic energy in a radiation pattern; at least one radio, the at least one radio being at least substantially contained within the housing and being connected to the first RF feed, the second RF feed and the third RF feed; and at least one of: a power cord and a USB cable for electrically connecting the antenna device to a second device, wherein the first plurality of radiators is configured for operating over a first frequency band, the second plurality of radiators is configured for operating over a second frequency band and the antenna element is configured for operating over a third frequency band.

A still further embodiment of the present invention is directed to an antenna assembly, including: a first feed board, the first feed board including a ground plane; a first plurality of radiators, the first plurality of radiators being connected to the first feed board; a first RF feed, the first RF feed being connected to the first feed board and the first plurality of radiators, the first RF feed configured for feeding the first plurality of radiators via the first feed board, wherein the first plurality of radiators, in response to receiving said feeding, is configured for radiating electromagnetic energy in a radiation pattern; a second feed board, the second feed board including a ground plane, the second feed board being connected to and stacked upon the first plurality of radiators; an antenna element, the antenna element being connected to the second feed board; and a second RF feed, the second RF feed being connected to the second feed board and the antenna element, the second RF feed configured for feeding the antenna element via the second feed board, wherein the antenna element, in response to receiving said feeding from the second RF feed, is configured for radiating electromagnetic energy in a radiation pattern, wherein the first plurality of radiators is configured for operating over a first frequency band and the antenna element is configured for operating over a second frequency band.

A further embodiment of the present invention is directed to an antenna assembly, including: a feed board, the feed board including a ground plane; a plurality of radiators, the plurality of radiators being connected to the feed board, the plurality of radiators being generally wedge-shaped radiators, the plurality of radiators being arranged in a generally circular arrangement on the feed board; an RF feed, the RF feed being connected to the feed board and the plurality of radiators, the RF feed configured for feeding the plurality of radiators via the feed board, wherein the plurality of radiators, in response to receiving said feeding from the RF feed, is configured for radiating electromagnetic energy in a radiation pattern.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
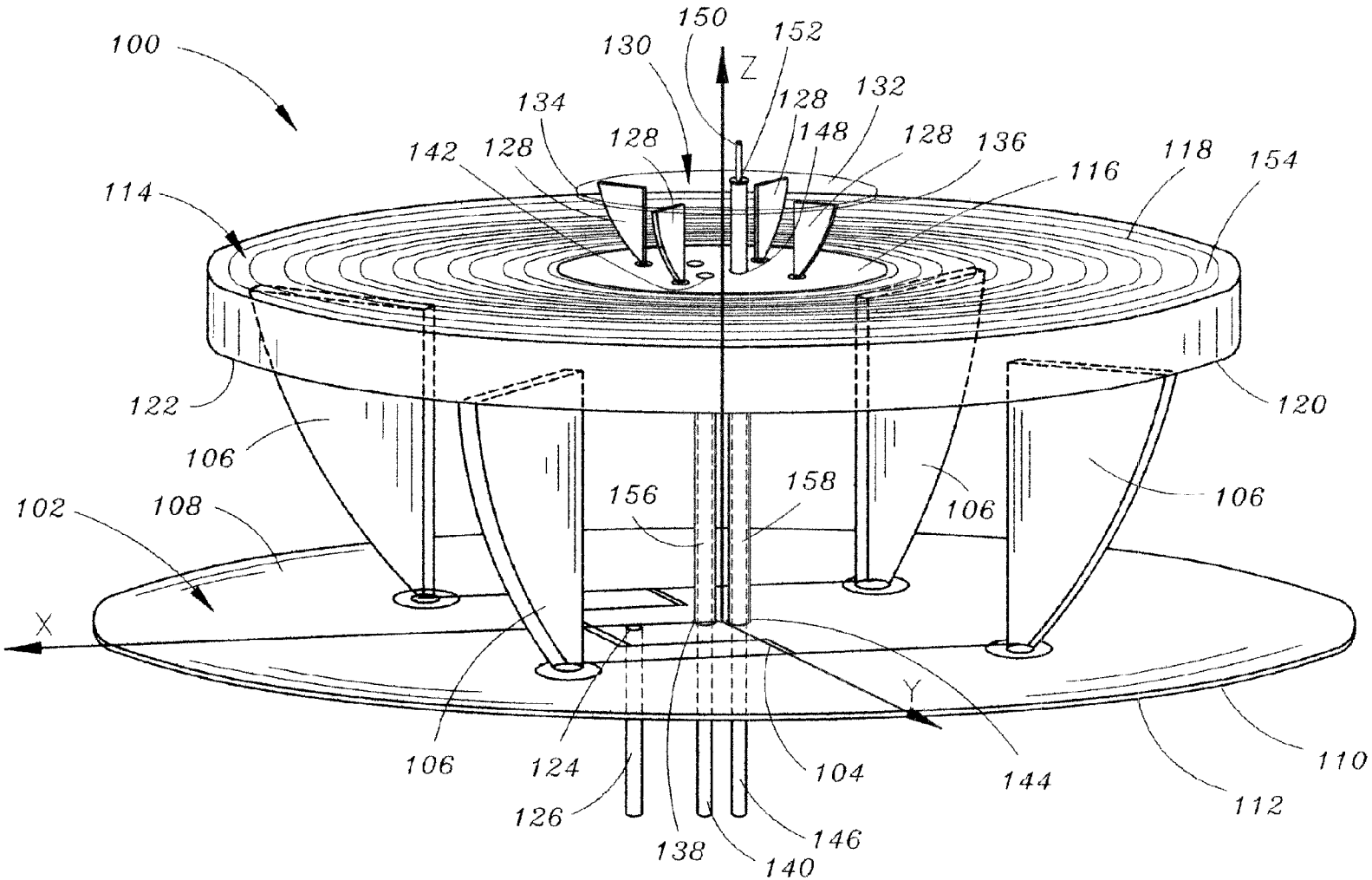
FIG. 1 is a view of an antenna assembly in accordance with an exemplary embodiment of the present invention.

Referring to FIG. 1, an antenna assembly 100 in accordance with an exemplary embodiment of the present invention is shown. In an exemplary embodiment of the present invention, the antenna assembly 100 includes a first Radio Frequency (RF) substrate 102 (ex.—a first feed board 102). For example, the first feed board 102 may be formed of Printed Circuit Board (PCB) material. In still further embodiments of the present invention, the first feed board 102 may include a power divider 104 (ex.—a 1:N power divider, N being the number of radiators connected to the power divider).

In exemplary embodiments of the present invention, the antenna assembly 100 further includes a first plurality of (ex.—3 or more) antenna elements or radiators 106. For instance, the radiators 106 included in the first plurality of radiators 106 may be generally wedge-shaped or generally triangular-shaped radiators 106 as shown in the illustrated embodiment in FIG. 1, or may be one or more of various other shapes. In further embodiments of the present invention, the radiators 106 included in the first plurality of radiators 106 may be connected to (exs.—may be mounted upon or supported upon) a first surface 108 (ex.—a top surface 108) of the first feed board 102 and may further be electrically connected to the first feed board 102. In still further embodiments of the present invention, the antenna assembly 100 may further include a first ground plane 110. The first ground plane 110 may be configured upon a second surface 112 (ex.—a bottom surface) of the first feed board 102, the second surface 112 being configured generally opposite the first surface 108. For instance, the first ground plane 110 may be a metal layer, metallization layer and/or metal foil layer (ex.—95% copper foil layer) which has been formed upon (ex.—patterned upon) the bottom surface 112 of the first feed board 102. In further embodiments, the radiators 106 included in the first plurality of radiators 106 may be electrically connected to the first ground plane 110 via the first feed board 102.

In current exemplary embodiments of the present invention, the antenna assembly 100 further includes a second RF substrate 114 (ex.—a second feed board 114). For example, the second feed board 114 may be formed of PCB material. In further embodiments of the present invention, the second feed board 114 may include a power divider (ex.—a 1:N power divider, N being the number of radiators connected to the power divider) 116. In still further embodiments of the present invention, the second feed board 114 may include a first surface 118 (ex.—a top surface 118) and a second surface 120 (ex.—a bottom surface 120), the second surface 120 being configured generally opposite the first surface 118.

In exemplary embodiments of the present invention, the antenna assembly 100 may further include a second ground plane 122. The second ground plane 122 may be configured upon the second (ex.—bottom) surface 120 of the second feed board 114. For instance, the second ground plane 122 may be a metal layer which has been formed upon (ex.—patterned upon) the bottom surface 120 of the second feed board 114. In further embodiments of the present invention, the radiators 106 included in the first plurality of radiators 106 may be connected to the second ground plane 122. In still further embodiments of the present invention, the second feed board 114 may be supported upon (exs.—mounted upon, stacked upon) the radiators 106 included in the first plurality of radiators 106.

In current exemplary embodiments of the present invention, the first feed board 102 may be configured with a first feed aperture 124 (ex.—a feed port 124). The first feed aperture 124 may be configured for receiving a first RF feed 126, the first RF feed 126 configured for being connected to the power divider 104 of the first feed board 102. In further embodiments of the present invention, the first feed board 102, the power divider 104 and the first RF feed 126 may be included as part of and/or may form a first feed network which is configured for feeding (ex.—providing a feed to) the radiators 106 included in the first plurality of radiators 106. For example, the first feed network may be a microstrip or stripline feed network. In still further embodiments of the present invention, the radiators 106 included in the first plurality of radiators 106 may be configured, based upon the feed provided by the first feed network, for radiating electromagnetic energy in a radiation pattern. In further embodiments of the present invention, the design of the first feed network may determine the shape of the radiation pattern provided by the radiators 106 included in the first plurality of radiators 106. For example, in at least one exemplary embodiment of the present invention, the first feed network may be configured for feeding the radiators 106 of the first plurality of radiators 106 in-phase, thereby causing the radiators 106 included in the first plurality of radiators 106 to provide an omni-directional radiation pattern (ex.—an omni-directional beam). In alternative embodiment(s) of the present invention, the first feed network may be configured for feeding the radiators 106 of the first plurality of radiators 106 out-of-phase, thereby allowing the antenna assembly 100 to produce a directional beam.

In exemplary embodiments of the present invention, the antenna assembly 100 may further include a second plurality of (ex.—3 or more) antenna elements or radiators 128. For instance, the radiators 128 included in the second plurality of radiators 128 may be generally wedge-shaped or generally triangular-shaped radiators 128, as shown in the illustrated embodiment of FIG. 1, or may be one or more of various other shapes. In further embodiments of the present invention, the radiators 128 included in the second plurality of radiators 128 may be connected to (exs.—mounted upon or supported upon) the top surface 118 of the second feed board 114, and may further be electrically connected to the second feed board 114. In still further embodiments of the present invention, the radiators 128 included in the second plurality of radiators 128 may be electrically connected to the second ground plane 122 via the second feed board 114.

In current exemplary embodiments of the present invention, the antenna assembly 100 further includes a third RF substrate 130 (ex.—a third feed board 130). For example, the third feed board 130 may be formed of PCB material. In further embodiments of the present invention, the third feed board 130 may include a first surface 132 (ex.—a top surface 132) and a second surface 134 (ex.—a bottom surface 134), the second surface 134 being configured generally opposite the first surface 132.

In exemplary embodiments of the present invention, the antenna assembly 100 may further include a third ground plane 136. The third ground plane 136 may be configured upon the second (ex.—bottom) surface 134 of the third feed board 130. For instance, the third ground plane 136 may be a metal layer which has been formed upon (ex.—patterned upon) the bottom surface 134 of the third feed board 130. In further embodiments of the present invention, the radiators 128 included in the second plurality of radiators 128 may be connected to the third ground plane. In still further embodiments of the present invention, the third feed board 130 may be supported upon (exs.—may be mounted upon, stacked upon) the radiators 128 included in the second plurality of radiators 128.

In current exemplary embodiments of the present invention, the first feed board 102 may be configured with a second feed aperture 138. The second feed aperture 138 may be configured allowing passage of a second RF feed 140 through or via the second feed aperture 138. For example, the second feed aperture 138 may be a generally central-located channel formed through the first feed board 102, extending longitudinally through the top surface 108 and ground plane 110 of the first feed board 102. In further embodiments of the present invention, the second RF feed 140 may be configured for being positioned (exs.—threaded, routed) through the second feed aperture 138 and connected to the power divider 116 of the second feed board 114 via a first feed aperture 142 of the second feed board 114. The second feed board 114, power divider 116 and the second RF feed 140 may be included as part of and/or may form a second feed network which is configured for feeding (ex.—providing a feed to) the radiators 128 included in the second plurality of radiators 128. For example, the second feed network may be a microstrip or stripline feed network.

In further embodiments of the present invention, the radiators 128 included in the second plurality of radiators 128 may be configured, based upon the feed provided by the second feed network, for radiating electromagnetic energy in a radiation pattern. In still further embodiments of the present invention, the design of the second feed network may determine the shape of the radiation pattern provided by the radiators 128 included in the second plurality of radiators 128. For example, in at least one exemplary embodiment of the present invention, the second feed network may be configured for feeding the radiators 128 of the second plurality of radiators 128 in-phase, thereby causing the radiators 128 included in the second plurality of radiators 128 to provide an omni-directional radiation pattern (ex.—an omni-directional beam). In alternative embodiment(s) of the present invention, the second feed network may be configured for feeding the radiators 128 of the first plurality of radiators 128 out-of-phase, thereby allowing the antenna assembly 100 to produce a directional beam.

In exemplary embodiments of the present invention, the first feed board 102 may be configured with a third feed aperture 144. The third feed aperture 144 may be configured for allowing passage of a third RF feed 146 through or via the third feed aperture 144. For example, the third feed aperture 144 may be a generally central-located channel formed through the first feed board 102, extending longitudinally through the top surface 108 and ground plane 110 of the first feed board 102. In further embodiments of the present invention, the third RF feed 146 may be configured for being positioned (exs.—threaded, routed) through the third feed aperture 144. In still further embodiments of the present invention, the second feed board 114 may include a second feed aperture 148, said second feed aperture 148 being a longitudinally extending channel formed through the second feed board 114 (ex.—formed through the top surface 118 of the second feed board 114 and the ground plane 122 of the second feed board). As mentioned above, the third RF feed 146 may be configured for being positioned (exs.—threaded, routed) through the third feed aperture 144 of the first feed board 102, and in further exemplary embodiments of the present invention, is further configured for being positioned (exs.—threaded, routed) through the second feed aperture 148 of the second feed board 114.

In current exemplary embodiments of the present invention, an antenna element 150 may be connected to (exs.—mounted upon or supported upon) the top surface 132 of the third feed board 130. For example, the antenna element 150 may be a monopole antenna element 150. In alternative embodiments of the present invention, the antenna element 150 may be a more complex antenna type. In further embodiments of the present invention, the antenna element 150 may be electrically connected to the third ground plane 136 via the third feed board 130. In still further exemplary embodiments of the present invention, the third feed board 130 includes a feed aperture 152 (ex.—feed port 152). As mentioned above, the third RF feed 146 may be configured for being positioned (exs.—threaded, routed) through the third feed aperture 144 of the first feed board 102, through the second feed aperture 148 of the second feed board 114, and in further exemplary embodiments of the present invention, is further configured for being received by the feed aperture 152 of the third feed board 130. In further embodiments of the present invention, the third RF feed 146 and third feed board 130 may form a third feed network 315 which is configured for feeding (ex.—providing a feed to) antenna element 150. For example, the third feed network 315 may be a microstrip or stripline feed network. In still further embodiments, the antenna element 150 may be configured, based upon the feed provided by the third feed network 315 for radiating electromagnetic energy in a radiation pattern.

In exemplary embodiments of the present invention, the first plurality of radiators 106, the second plurality of radiators 128 and antenna element 150 may each be broadband (ex.—30 to 50 percent bandwidth). In further embodiments of the present invention, the stackable antenna assembly 100 of may be configured for supporting multiple frequency bands (ex.—may be a multiband antenna 100). For instance: the first RF feed 126 may be a low band RF feed 126 (ex.—a L band RF feed) and the first plurality of radiators 106 may be configured for operating over the L band range of frequencies (exs.—within the 1 Gigahertz (GHz) to 2 GHz frequency band); the second RF feed 140 may be a mid band RF feed 140 (ex.—a C band RF feed) and the second plurality of radiators 128 may be configured for operating over the C band range of frequencies (ex.—within the 4 GHz to 8 GHz frequency band); the third RF feed 146 may be a high band RF feed 146 (ex.—a $K_u$ band RF feed) and antenna element 150 may be configured for operating over the $K_u$ band range of frequencies (ex.—within the 12 GHz to 18 GHz frequency band). In alternative embodiments of the present invention, the stackable antenna assembly 100 may be configured with additional radiators/antenna elements, feed boards, and RF feeds as needed for supporting additional (ex.—more than 3) frequency bands.

Figure 3:
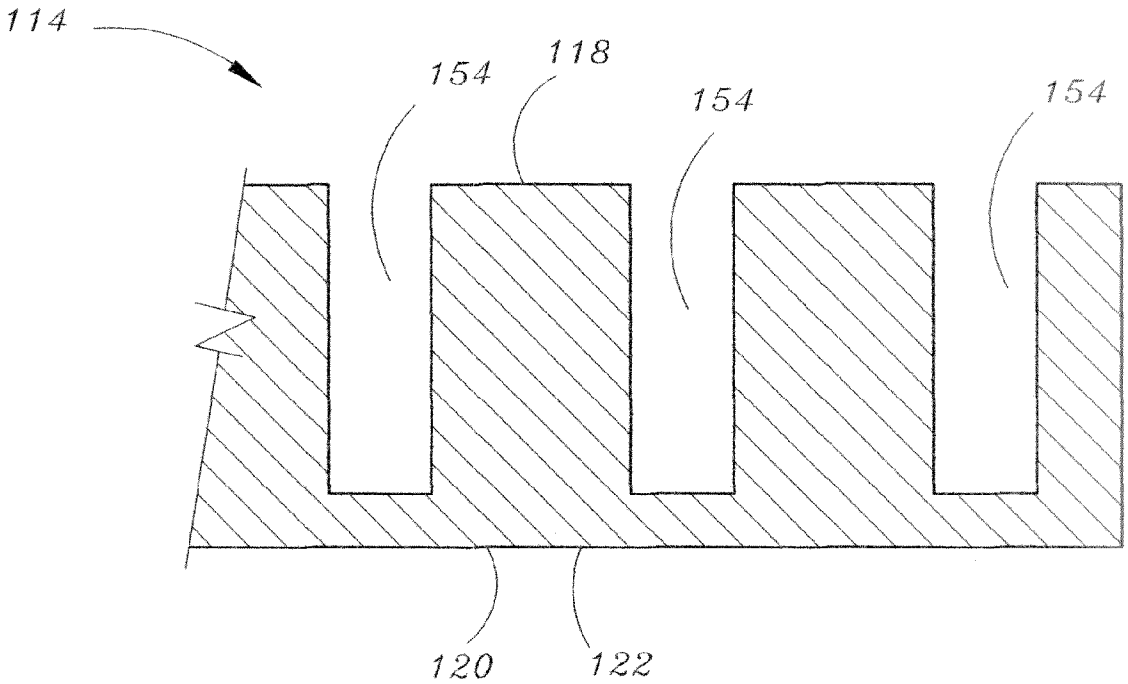
FIG. 3 is a cross-sectional view of a feed board of the antenna assembly of FIG. 1 in accordance with an exemplary embodiment of the present invention.

In current exemplary embodiments of the present invention, the top surface 118 of the second feed board 114 may be a high impedance surface. For instance, the top surface 118 of the second feed board 114 may include or may be at least partially formed of metal (exs.—corrugated metal, aluminum), said metal having grooves 154 (ex.—¼ wavelength-deep grooves) formed therein (as shown in FIG. 3). In still further embodiments of the present invention, the high impedance surface (ex.—the top surface 118 of the second feed board 114) may prevent scattering effects caused by the first plurality of radiators 106 from adversely affecting performance of the second plurality of radiators 128 and antenna element 150. For example, the grooves 154 may act as a choke for changing the phase of reflection of signals and for mitigating undesired scattering caused by the first plurality of radiators 106.

In exemplary embodiments of the present invention, the first plurality of radiators 106, the second plurality of radiators 128 and antenna element 150 may each be configured for providing monopole-like radiation patterns (ex.—0 dBi). In further embodiments of the present invention, each radiator 106 included in the first plurality of radiators 106, each radiator 128 included in the second plurality of radiators, and antenna element 150 may be configured (ex.—shaped) to provide optimal bandwidth and may be further configured (ex.—sized) for minimizing the profile of the antenna assembly 100. For example, each radiator 106 included in the first plurality of radiators 106 may be sized so that the distance between the first feed board 102 and the second feed board 114 is approximately ⅛ lamda in height, while the first feed board 102 may have a diameter of ½ lamda.

In current exemplary embodiments of the present invention, one or more of the first RF feed 126, the second RF feed 140 and the third RF feed 146 may each include or may each be at least partially enclosed in (ex.—fed through) a protective casing (exs.—a conduit, hollow casing). For example, in the illustrated embodiment of the present invention shown in FIG. 1, a conduit 156 surrounding the second RF feed 140 may function as a central post 156 upon which the second feed board 114 may be at least partially supported and around which the first plurality of radiators 106 may be located or positioned. Further, a conduit 158 surrounding the third RF feed 146 may function as a central post 158 upon which the third feed board 130 may be at least partially supported and around which the second plurality of radiatiors 128 may be configured. In alternative embodiments of the present invention, the number of conduits which are implemented for protecting the RF feeds (126, 140, 146) may vary, for instance, one conduit may be used to enclose multiple feeds, etc. In further alternative embodiments of the present invention, the number of feed apertures implemented in the feed boards (102, 114, 130) may vary as well, for instance, one feed aperture may allow for passage of multiple RF feeds, etc.

Figure 2:
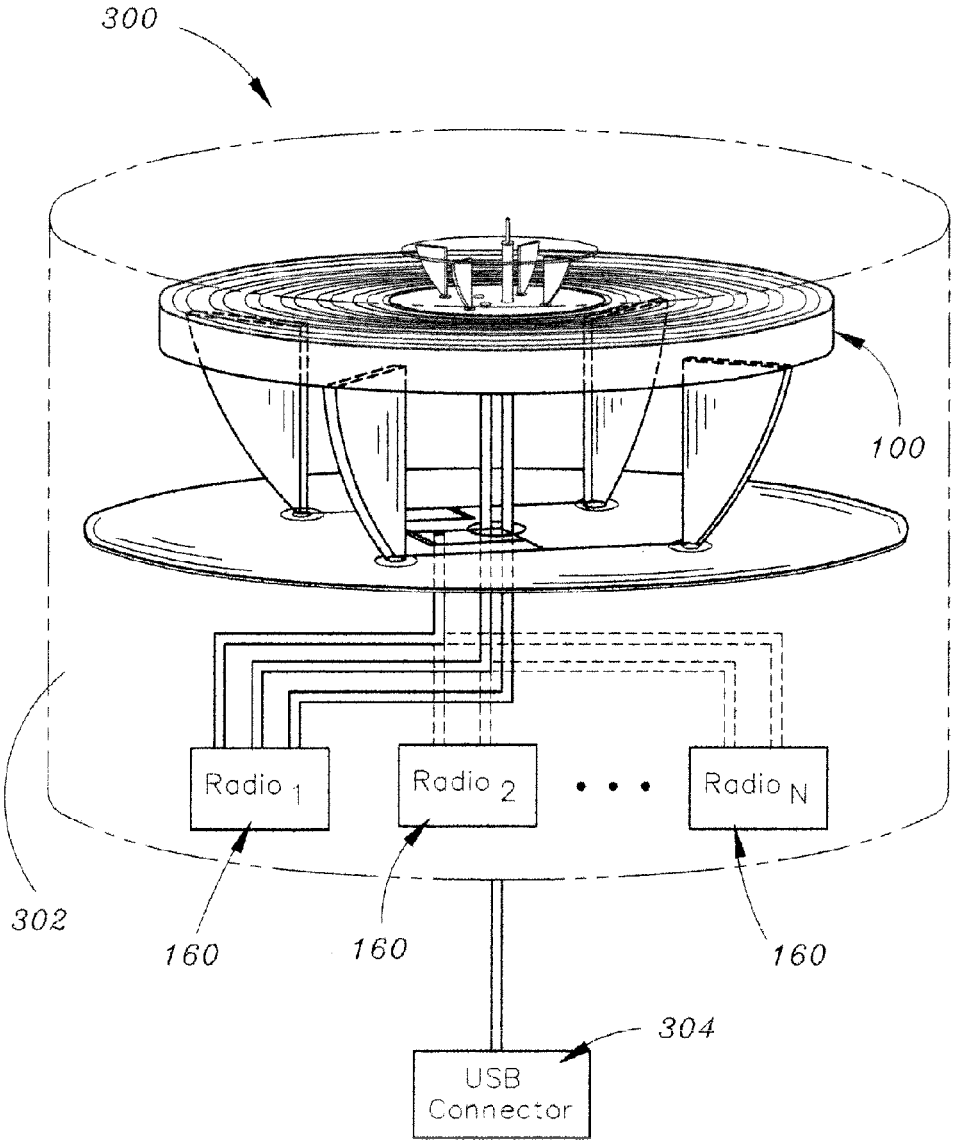
FIG. 2 is a view of an antenna device implementing the antenna assembly of FIG. 1 in accordance with an exemplary embodiment of the present invention.

In exemplary embodiments of the present invention, the antenna assembly 100 may include one or more radios 160, the one or more radios 160 configured for being connected to the RF feeds (126, 140, 146). In further embodiments of the present invention, the antenna assembly 100 may be implemented as part of an antenna device 300 as shown in FIG. 2. The antenna device 300 may include a housing (ex.—a low-profile, circular puck-shaped housing 302) which is configured for enclosing (ex.—at least substantially containing and being connected to) the antenna assembly 100. In further embodiments, the antenna device 300 may include a power cord or USB cable 304 configured for electrically connecting the antenna device 300 (ex.—the antenna assembly 100 of the antenna device 300) to a computer.

In current exemplary embodiments of the present invention, the antenna assembly 100 and antenna device 300 may be implemented in various applications. For example, the antenna assembly 100 and antenna device 300 may be configured for implementation in or with: military systems; Traffic Collision Avoidance Systems (TCAS), Ultra High Frequency Communication (UHF com) systems, Mini Common Data Link (MiniCDL) antenna systems, Quint Networking Technologies (QNT) systems, Remotely Operated Video Enhanced Receiver (ROVER) systems, and/or Global Positioning System (GPS) systems. The integrated hardware of the antenna assembly 100 as disclosed herein provides significant Size Weight and Power (SWAP) over implementing separate antenna assemblies.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An antenna assembly, comprising:

a first feed board, the first feed board including a ground plane;

a first plurality of radiators, the first plurality of radiators being connected to the first feed board;

a first RF feed, the first RF feed being connected to the first feed board and the first plurality of radiators, the first RF feed configured for feeding the first plurality of radiators via the first feed board, wherein the first plurality of radiators, in response to receiving said feeding, is configured for radiating electromagnetic energy in a radiation pattern;

a second feed board, the second feed board including a ground plane, the second feed board being connected to and stacked upon the first plurality of radiators, the second feed board includes a grooved metal surface portion, the grooved metal surface portion of the second feed board promotes mitigation of scattering caused by the first plurality of radiators;

a second plurality of radiators, the second plurality of radiators being connected to the second feed board;

a second RF feed, the second RF feed being connected to the second feed board and the second plurality of radiators, the second RF feed configured for feeding the second plurality of radiators via the second feed board, wherein the second plurality of radiators, in response to receiving said feeding from the second RF feed, is configured for radiating electromagnetic energy in a radiation pattern;

a third feed board, the third feed board including a ground plane, the third feed board being connected to and stacked upon the second plurality of radiators;

an antenna element, the antenna element being connected to the third feed board; and a third RF feed, the third RF feed being connected to the third feed board and the antenna element, the third RF feed being configured for feeding the antenna element via the third feed board, wherein the antenna element, in response to receiving said feeding from the third RF feed, is configured for radiating electromagnetic energy in a radiation pattern, wherein the first plurality of radiators is configured for operating over a first frequency band, the second plurality of radiators is configured for operating over a second frequency band and the antenna element is configured for operating over a third frequency band.

2. An antenna assembly as claimed in claim 1, wherein the first frequency band, the second frequency band, and the third frequency band are non-overlapping.

3. An antenna assembly as claimed in claim 2, wherein the first frequency band is L band, the second frequency band is C band and the third frequency band is $K_u$ band.

4. An antenna assembly as claimed in claim 1, wherein the antenna element is a monopole antenna.

5. An antenna assembly as claimed in claim 1, wherein the first feed board and the second feed board include power dividers.

6. An antenna assembly as claimed in claim 1, wherein the first RF feed, the second RF feed, and the third RF feed are configured for being connected to at least one radio.

7. An antenna assembly as claimed in claim 1, wherein at least one of the first RF feed, the second RF feed, and the third RF feed is at least partially enclosed in a hollow protective casing.

8. An antenna assembly as claimed in claim 1, wherein the radiation pattern provided by the first plurality of radiators and the radiation pattern provided by the second plurality of radiators is at least one of: omnidirectional and directional.

9. An antenna device, comprising:

a housing; and an antenna assembly, the antenna assembly being connected to and at least substantially contained within the housing, the antenna assembly including:

a first feed board, the first feed board including a ground plane; a first plurality of radiators, the first plurality of radiators being connected to the first feed board; a first RF feed, the first RF feed being connected to the first feed board and the first plurality of radiators, the first RF feed configured for feeding the first plurality of radiators via the first feed board, wherein the first plurality of radiators, in response to receiving said feeding, is configured for radiating electromagnetic energy in a radiation pattern;

a second feed board, the second feed board including a ground plane, the second feed board being connected to and stacked upon the first plurality of radiators, the second feed board includes a grooved metal surface portion, the grooved metal surface portion of the second feed board promotes mitigation of scattering caused by the first plurality of radiators, a second plurality of radiators, the second plurality of radiators being connected to the second feed board and a second RF feed, the second RF feed being connected to the second feed board and the second plurality of radiators, the second RF feed configured for feeding the second plurality of radiators via the second feed board, wherein the second plurality of radiators, in response to receiving said feeding from the second RF feed, is configured for radiating electromagnetic energy in a radiation pattern; and at least one radio, the at least one radio being at least substantially contained within the housing and being connected to the first RF feed and the second RF feed;

a third feed board, the third feed board including a ground plane, the third feed board being connected to and stacked upon the second plurality of radiators;

an antenna element, the antenna element being connected to the third feed board; and a third RF feed, the third RF feed being connected to the third feed board and the antenna element, the third RF feed being configured for feeding the antenna element via the third feed board, wherein the antenna element, in response to receiving said feeding from the third RF feed, is configured for radiating electromagnetic energy in a radiation pattern, the third RF feed being configured for being connected to the at least one radio, wherein the first plurality of radiators is configured for operating over a first frequency band, the second plurality of radiators is configured for operating over a second frequency band and the antenna element is configured for operating over a third frequency band.

10. An antenna device as claimed in claim 9, wherein the first frequency band is L band, the second frequency band is C band and the third frequency band is $K_u$ band.

11. An antenna device as claimed in claim 9, wherein the first feed board and the second feed board include power dividers.

12. An antenna device as claimed in claim 9, wherein at least one of the first RF feed, the second RF feed, and the third RF feed is at least partially enclosed in a conduit casing.

13. An antenna device as claimed in claim 9, wherein the radiation pattern provided by the first plurality of radiators and the radiation pattern provided by the second plurality of radiators is at least one of: omnidirectional and directional.

14. An antenna device as claimed in claim 9, further comprising:

at least one of: a power cord and a USB cable for electrically connecting the antenna device to a second device.

* * * * *